US012612278B2

(12) United States Patent
Picchi et al.

(10) Patent No.: US 12,612,278 B2
(45) Date of Patent: Apr. 28, 2026

(54) UNWINDER, IN PARTICULAR FOR UNWINDING REELS OF PAPER, SEMI-AUTOMATIC PLANT COMPRISING SUCH UNWINDER AND PROCESS FOR UNWINDING REELS

(71) Applicant: GAMBINI S.P.A., Milan (IT)

(72) Inventors: Fabio Picchi, Lammari (IT); Giovanni Buffa, Ponte Buggianese (IT); Paolo Lazzareschi, Lucca (IT)

(73) Assignee: GAMBINI S.P.A., Milan (IT)

( * ) Notice: Subject to any disclaimer, the term of this patent is extended or adjusted under 35 U.S.C. 154(b) by 250 days.

(21) Appl. No.: 18/194,971

(22) Filed: Apr. 3, 2023

(65) Prior Publication Data

US 2023/0391572 A1 Dec. 7, 2023

(30) Foreign Application Priority Data

Jun. 3, 2022 (IT) ..... 102022000011762

(51) Int. Cl.
*B65H 19/12* (2006.01)
*B65H 16/08* (2006.01)
(Continued)

(52) U.S. Cl.
CPC ..... *B65H 19/12* (2013.01); *B65H 16/08* (2013.01); *B65H 16/103* (2013.01); *B65H 19/18* (2013.01);
(Continued)

(58) Field of Classification Search
CPC ..... B65H 19/10; B65H 19/12; B65H 19/123; B65H 19/126; B65H 19/18;
(Continued)

(56) References Cited

U.S. PATENT DOCUMENTS 1,623,277 A * 4/1927 Scott ..... B65H 19/1852 242/552
1,651,840 A * 12/1927 Scott ..... B65H 19/1852 242/552
(Continued)

FOREIGN PATENT DOCUMENTS

EP 0 740 637 11/1996
EP 1 348 658 A1 10/2003
(Continued)

OTHER PUBLICATIONS

Italian Search Report issued Jan. 4, 2023, in Italian Application 102022000011762 filed on Jun. 3, 2022, 8 pages (with English Translation of Categories of Cited Documents and Written Opinion).

*Primary Examiner* — Victoria P Augustine
*Assistant Examiner* — Raveen J Dias
(74) *Attorney, Agent, or Firm* — Oblon, McClelland, Maier & Neustadt, L.L.P.

(57) ABSTRACT

An unwinder for unwinding reels of paper includes a supporting structure partially closed and defining an internal space suitable for unwinding at least one reel; the supporting structure includes: a first lateral support; a second lateral support spaced from the first support; a crosspiece interposed above between the first and the second support defining with the first support and second support the partially closed structure; the unwinder further includes: a first axial unwinding system placed at the first support and configured to axially unwind a first reel; a second axial unwinding system placed at the second support and configured to unwind a second reel; a joining device placed at the crosspiece and configured to make a joint between a first ply belonging to the first reel and a second ply belonging to the second reel to perform a reel exchange.

11 Claims, 6 Drawing Sheets

(51) Int. Cl.
*B65H 16/10* (2006.01)
*B65H 19/18* (2006.01)

(52) U.S. Cl.
CPC ..... *B65H 19/1805* (2013.01); *B65H 19/1826* (2013.01); *B65H 19/1831* (2013.01); *B65H 19/1836* (2013.01); *B65H 19/1842* (2013.01); *B65H 19/1852* (2013.01); *B65H 19/1863* (2013.01); *B65H 19/1873* (2013.01); *B65H 2301/41352* (2013.01); *B65H 2301/413526* (2013.01); *B65H 2402/31* (2013.01); *B65H 2402/32* (2013.01); *B65H 2405/422* (2013.01); *B65H 2405/4221* (2013.01)

(58) Field of Classification Search
CPC ..... B65H 19/1805; B65H 19/1826; B65H 19/1831; B65H 19/1836; B65H 19/1842; B65H 19/1852; B65H 19/1857; B65H 19/1863; B65H 19/1873; B65H 16/02; B65H 16/06; B65H 16/10; B65H 16/103; B65H 2301/413; B65H 2301/4132; B65H 2301/41322; B65H 2301/413223; B65H 2301/41324; B65H 2301/413246; B65H 2301/4134; B65H 2301/41342; B65H 2301/41346; B65H 2301/4173; B65H 2301/41505; B65H 2301/41506; B65H 2301/415063; B65H 2301/415066; B65H 2301/41508; B65H 2402/31; B65H 2402/32; B65H 2402/33; B65H 2405/422; B65H 2405/4221; B65H 19/1884; B65H 19/1889
See application file for complete search history.

(56) References Cited

U.S. PATENT DOCUMENTS 1,671,685 A * 5/1928 Scott ..... B65H 19/1873 242/560.3
1,693,436 A * 11/1928 Drange ..... B65H 19/1852 242/552
3,645,463 A * 2/1972 Helm ..... B65H 19/1873 156/506
3,740,296 A * 6/1973 McDonald ..... B65H 19/00 242/555.4
3,841,944 A * 10/1974 Harris, Jr. ..... B65H 19/1873 156/507
3,858,819 A * 1/1975 Butler, Jr. ..... B65H 19/1852 242/556.1
3,863,854 A * 2/1975 Tokuno ..... B65H 19/1815 242/555.4
3,895,763 A * 7/1975 Tokuno ..... B65H 19/1821 242/556.1
3,918,655 A * 11/1975 Hillner ..... B65H 19/1852 242/421.7
3,920,502 A * 11/1975 Tokuno ..... B65H 19/1873 156/159
3,948,715 A * 4/1976 Tokuno ..... B65H 19/1873 242/554.2
3,974,490 A * 8/1976 Mori ..... B65H 19/1836 242/563.2
RE29,365 E * 8/1977 Butler, Jr. ..... B65H 19/1852 242/556.1
4,065,067 A * 12/1977 Martinez ..... B65H 19/1852 242/552
4,082,599 A * 4/1978 Kozima ..... B65H 19/1873 242/555.4
4,100,012 A * 7/1978 Meihofer ..... B65H 23/1888 156/361
4,170,506 A * 10/1979 Marschke ..... B65H 19/1873 156/159
4,262,855 A * 4/1981 Haag ..... B65H 19/1873 226/104
4,284,463 A * 8/1981 Wright ..... B65H 19/18 83/508
4,519,858 A * 5/1985 Martin ..... B65H 19/1852 156/64
4,735,372 A * 4/1988 Seki ..... B65H 19/126 242/559.1
4,792,103 A * 12/1988 Schoonderbeek . B65H 19/1873 242/596.1
4,802,632 A * 2/1989 Fukuda ..... B65H 19/105 242/532.5
4,859,270 A * 8/1989 Martin ..... B65H 21/02 156/361
4,881,695 A * 11/1989 Beisswanger ..... B65H 19/1852 242/561
4,892,611 A * 1/1990 Wheeler ..... B65H 19/1873 156/518
4,919,353 A * 4/1990 Isowa ..... B65H 19/126 242/559.1
4,923,546 A * 5/1990 Wheeler ..... B65H 19/1873 156/304.3
4,949,910 A * 8/1990 Kleitz ..... B65H 19/123 242/563
5,679,195 A * 10/1997 O'Dwyer ..... B65H 19/1873 242/554.6
5,697,575 A * 12/1997 Moore ..... B65H 19/1863 242/555.3
5,716,022 A * 2/1998 Chiloff ..... B65H 19/1873 242/552
5,730,389 A * 3/1998 Biagiotti ..... B65H 19/1863 242/556.1
5,762,283 A * 6/1998 Buchmeyer ..... B65H 19/12 242/532.3
5,906,333 A * 5/1999 Fortuna ..... B65H 19/1836 242/555.2
5,975,457 A * 11/1999 Forbes ..... B65H 19/1873 242/555.2
6,030,496 A * 2/2000 Baggot ..... B65H 19/1852 162/111
6,042,047 A * 3/2000 Thievessen ..... B65H 16/06 242/399.1
6,355,139 B1 * 3/2002 Baggot ..... B65H 16/103 242/545.1
6,451,145 B1 * 9/2002 Forbes ..... B65H 19/1836 156/507
6,547,909 B1 * 4/2003 Butterworth ..... B65H 19/1873 242/555.2
6,786,264 B1 * 9/2004 Torres Martinez ..... B65H 19/1873 156/507
6,820,836 B2 * 11/2004 Sato ..... B65H 19/1852 242/562.1
6,966,961 B2 * 11/2005 Adami ..... B65H 19/1836 156/159
7,350,740 B2 * 4/2008 Benvenuti ..... B65H 19/126 242/555.3
7,500,634 B2 * 3/2009 Benvenuti ..... B65H 19/1836 242/555.3
7,618,004 B2 * 11/2009 Gelli ..... B65H 19/1836 242/555.3
8,628,038 B2 * 1/2014 Muller ..... B65H 19/1852 242/554.2
9,067,750 B2 * 6/2015 Casey ..... B26D 1/305
9,682,842 B2 * 6/2017 Takagawa ..... B65H 75/446
10,994,959 B2 * 5/2021 Picchi ..... B65H 19/20
11,254,534 B2 * 2/2022 Paolinelli ..... B65H 16/106
11,390,479 B2 * 7/2022 Adami ..... B65H 19/1863
11,548,747 B2 * 1/2023 Ruhland ..... B65H 23/105
11,685,624 B2 * 6/2023 Ruhland ..... B31F 5/06 242/559
11,691,837 B2 * 7/2023 Ruhland ..... B65H 19/1852 242/559
2003/0080235 A1 * 5/2003 Sato ..... B65H 19/1852 242/555.6

(56) References Cited

U.S. PATENT DOCUMENTS

2004/0084133 A1* 5/2004 Adami ..... B65H 19/1836 156/159
2004/0084561 A1* 5/2004 Clifford ..... B65H 19/1852 242/598.2
2005/0279461 A1* 12/2005 Adami ..... B65H 19/1863 242/324
2006/0157610 A1* 7/2006 Rann ..... B65H 19/126 242/560
2006/0169826 A1* 8/2006 Benvenuti ..... B65H 19/12 242/555
2006/0175457 A1* 8/2006 Benvenuti ..... B65H 19/126 242/555
2007/0113984 A1* 5/2007 Pasqualoni ..... B65H 19/1873 156/504
2007/0170300 A1* 7/2007 Titz ..... B65H 19/20 242/552
2010/0170978 A1* 7/2010 Muller ..... B65H 19/1852 242/552
2012/0211142 A1* 8/2012 Casey ..... B26D 1/305 83/13
2012/0236141 A1* 9/2012 Takagawa ..... B65H 75/425 348/95
2013/0248642 A1* 9/2013 Niwa ..... B65H 19/26 242/522
2014/0251528 A1* 9/2014 Cederholm ..... B65H 19/1852 156/159
2015/0291380 A1* 10/2015 Fischer ..... B65H 19/1852 242/552
2017/0088380 A1* 3/2017 Mark ..... B65H 19/1873
2017/0152120 A1* 6/2017 Montoya ..... B65H 23/0326
2017/0275116 A1* 9/2017 Gnan ..... B65H 19/1852
2017/0291784 A1* 10/2017 Adami ..... B65H 21/00
2017/0297849 A1* 10/2017 Gnan ..... B65H 21/00
2017/0327338 A1* 11/2017 Vergentini ..... B65H 19/265
2019/0241388 A1* 8/2019 Picchi ..... B65H 19/1836
2020/0255245 A1* 8/2020 Ruhland ..... C09J 7/405
2020/0391968 A1* 12/2020 Adami ..... B65H 19/1863
2021/0101516 A1* 4/2021 Ruhland ..... B60L 50/60
2022/0274798 A1* 9/2022 Ahn ..... H01M 4/0435
2023/0264913 A1* 8/2023 Choi ..... H01M 10/0404 156/379.8
2023/0294946 A1* 9/2023 Schubring ..... B65H 19/1863 242/555.3
2023/0373745 A1* 11/2023 Cini ..... B65H 19/1873
2025/0051121 A1* 2/2025 Lassalle ..... B65H 19/1852

FOREIGN PATENT DOCUMENTS

GB 215525 A 5/1924
GB 2210604 A * 6/1989 ..... B65H 16/06
WO WO 2013/076011 A1 5/2013

* cited by examiner

UNWINDER, IN PARTICULAR FOR UNWINDING REELS OF PAPER, SEMI-AUTOMATIC PLANT COMPRISING SUCH UNWINDER AND PROCESS FOR UNWINDING REELS

The present invention relates to an unwinder for unwinding reels. The present invention also relates to a plant, at least partly automatic, comprising such an unwinder and a process for unwinding reels.

The present invention is usefully employed for unwinding reels in the field of converting strip-shaped material, such as paper, to feed the strip-shaped material to subsequent processing and converting stations for the production of the finished product.

In particular, the present invention is applied for unwinding reels of paper of the so-called "tissue" type in the production process of articles such as toilet paper, kitchen paper, napkins and the like.

It is currently known to produce the aforesaid articles from large diameter reels, generally varying between 1.5 metres and 3 metres, wherein one or more plies of paper are wound. At an early stage of the process, these reels are unwound in special unwinders in order to be submitted to processes for obtaining semi-finished products such as rolls of paper known as "logs". Then, from these semi-finished products, through further processing and transformation steps, such as printing, embossing, laminating and still more, the finished products, such as the paper articles listed above, are obtained.

In particular, it is known that the unwinding process may be performed by unwinding the reel from the centre, rotating it axially, or by unwinding the reel from the outside.

Both axial and peripheral unwinders are known for these purposes.

Disadvantageously, in known unwinders, performing the reel exchange operation to replace an exhausted reel with a new one is a critical operation. Such a step in fact requires loading the new reel and then joining the ply of the exhausted reel with the ply of the new one, an operation which implies temporarily interrupting or slowing down the line. In fact, in the known unwinders, the unwinding of the new reel can be started after the unwinding of the first exhausted reel has been interrupted because it is necessary to place the new reel in the unwinder and to join the plies for the exchange of the two reels.

In the case of peripheral-type unwinders, which use belt systems to unwind the reel, the joining operation is even more critical due to the complexity resulting from the belt system.

Some unwinders of this type are for example disclosed in U.S. Ser. No. 11/254,534 B2, US 2006175457 A1 and WO 2013076011.

The task underlying the present invention is to make available an unwinder that allows to improve and optimise the quality of the unwinding process.

It is in particular the object of the present invention to speed up the exchange between an exhausted reel and a new reel and to ensure continuity of the process.

The above-mentioned task, as well as the objects mentioned and others which will better appear later, are achieved by an unwinder, by a plant, at least partly automatic, and by a process for unwinding reels.

Other features are provided in the dependent claims.

Further characteristics and advantages will become clearer from the description of preferred but not exclusive embodiments of an unwinder shown only by way of a non-limiting example with the aid of the accompanying drawings, in which.

Figure 10:
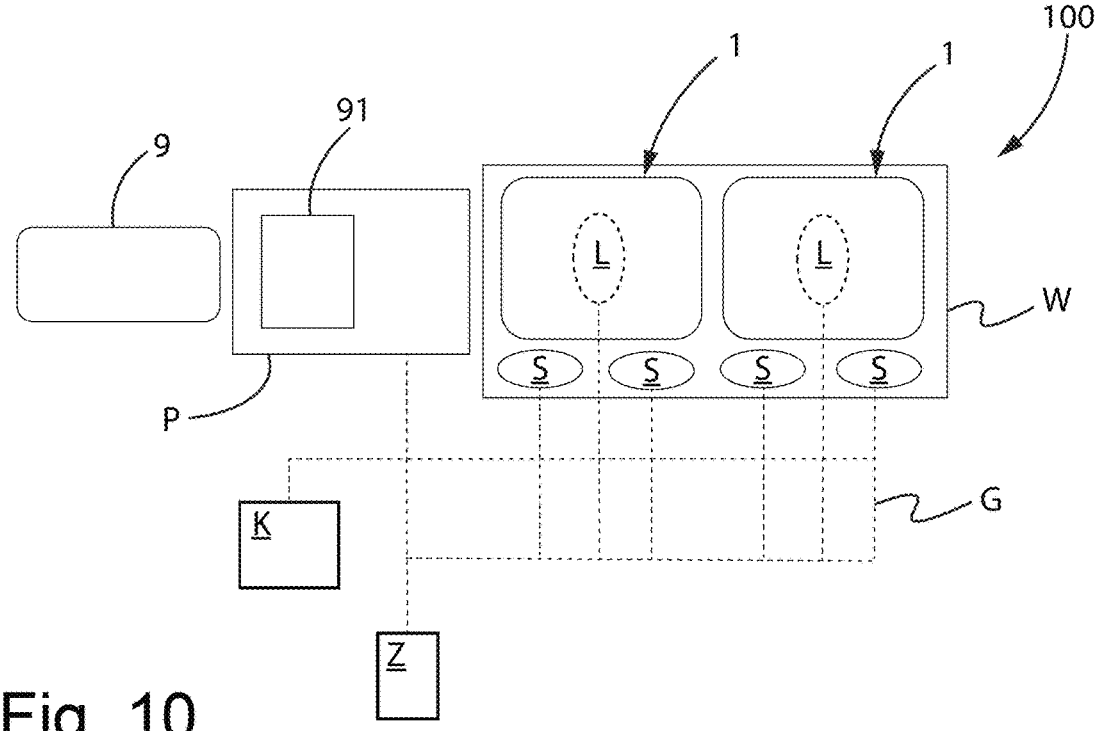
Figure 11A:
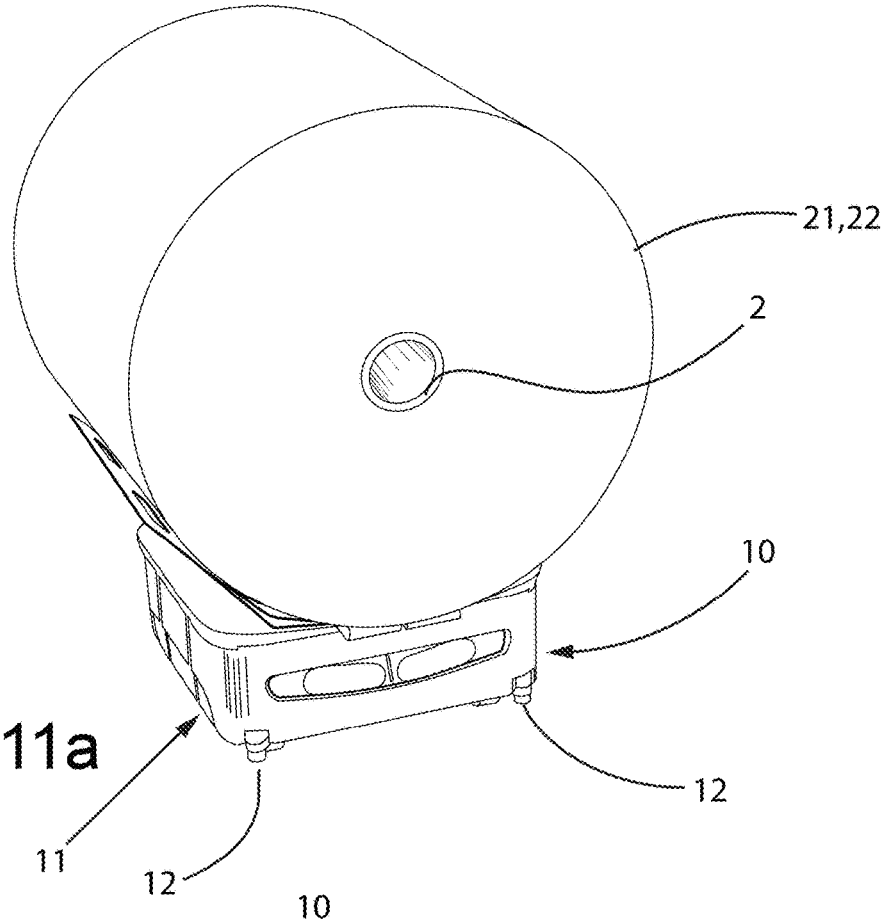
Figure 11B:
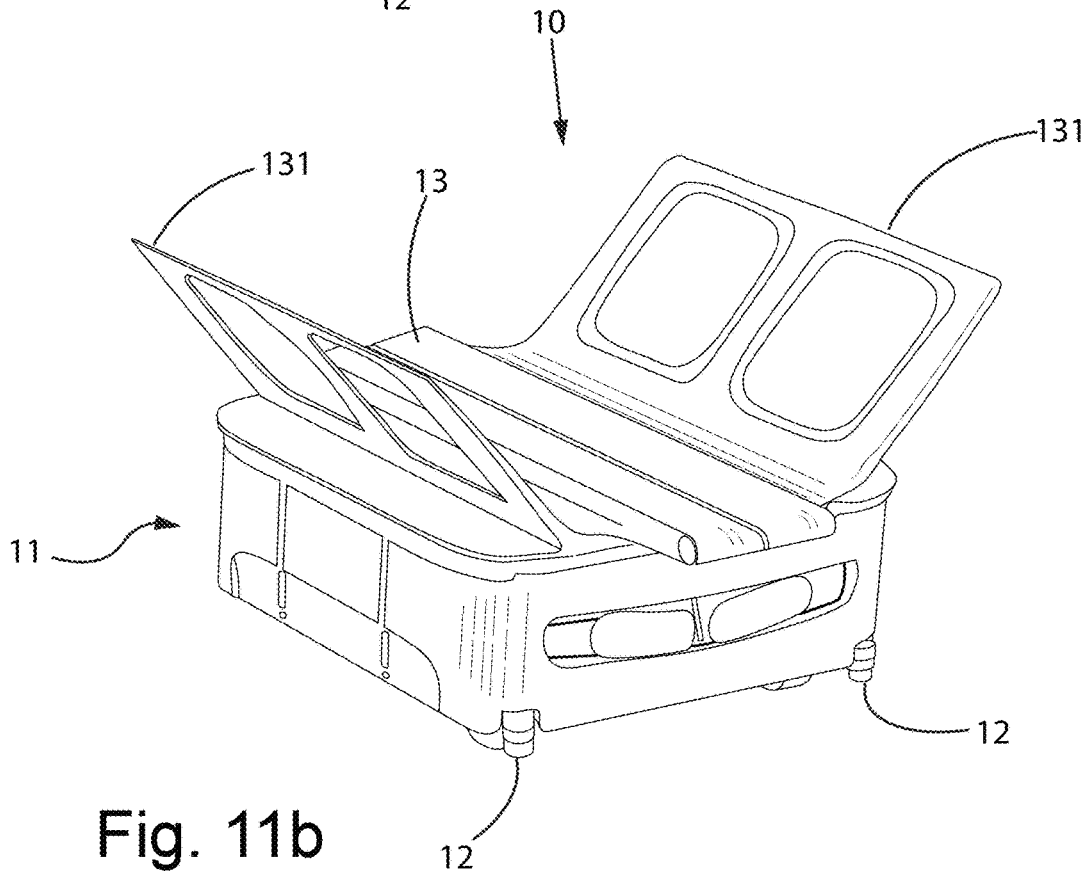

FIG. 10 schematically shows a plant according to the present invention;

FIGS. 11*a* and 11*b* show a transport element of an embodiment of a plant according to the present invention.

With reference to FIGS. 1-9, an unwinder is described hereinafter, denoted by reference number 1.

The unwinder 1 is used to unwind reels 21, 22 of paper.

The unwinder 1 according to the present invention comprises a supporting structure 3 that is partially closed and defining an internal space suitable for unwinding at least one reel 21, 22.

The unwinder 1 described hereinafter has a substantially symmetrical structure, and is configured to also have two reels 21, 22 loaded at the same time, a first reel 21 of which being unwound, to be exhausted, and a new second reel 22 to be unwound, with a diameter for example of 1.5 metres or 3 metres.

In particular, the supporting structure 3 comprises a first lateral support 31 and a second lateral support 32 spaced from the first support 31.

The supporting structure 3 also comprises a crosspiece 4 interposed above between the first 31 and the second 32 support. In particular, the crosspiece 4 defines with the first support 31 and the second support 32 the partially closed structure.

Note that the unwinder 1 according to the present invention further comprises a first axial unwinding system 5 placed at the first support 31 and configured to axially unwind a first reel 21.

The unwinder 1 further comprises a second axial unwinding system 6 placed at the second support 32 and configured to unwind a second reel 22.

The unwinder 1 is then configured to unwind reels 21, 22 loaded thereon by unwinding them from the centre by means of the unwinding systems 5 and 6. More details on the unwinding systems 5, 6 are provided in the hereinafter description.

The unwinder 1 comprises a joining device 40 placed at the crosspiece 4 and configured to make a joint between a first ply 210 belonging to the first reel 21 and a second ply 220 belonging to the second reel 22 to perform a reel exchange.

In particular, note that the second unwinding system 6 is configured to load the second reel 22 from a loading zone L after the first reel 21 being unwound on the first unwinding system 5 reaches a first predetermined diameter.

For example, the first predetermined diameter is ⅓ of the initial diameter of the reel 21, 22.

Preferably, the second new reel 22 is loaded when the first exhausted reel 21 reaches a further predetermined diameter below the first one.

The joining device 40 is thus configured to make the joint between the first reel 21 and the second reel 22 when the first reel 21 reaches a second predetermined diameter smaller than the first predetermined diameter.

The second predetermined diameter is also smaller than the further predetermined diameter.

For example, the second predetermined diameter is ⅙ of the initial diameter of the reel 21, 22.

The second unwinding system 6 is configured to unwind the second reel 22 after the joint has been made.

In particular, according to the present invention, the first unwinding system 5 is configured to interrupt unwinding the first reel 21 after the second unwinding system 6 has started unwinding the second reel 22.

What is stated in this description for the first reel 21 and for the second reel 22 also applies by reversing the terms, depending on which of the two unwinding systems 5, 6 is engaged in unwinding a reel 21, 22.

The unwinder 1 according to the present invention in fact ensures a continuous unwinding process, and the two unwinding systems 5 and 6 work alternately on respective reels 21, 22.

The unwinder 1 is automated, and comprises a control unit (not shown in the accompanying figures) configured to give certain commands to the various components of the unwinder 1, such as those mentioned above regarding unwinding systems 5, 6 and the joining device 40. More details on the operation of the unwinder 1 are hereinafter reported.

In greater detail, the first unwinding system 5 comprises two first arms 51, 52 coupled together and movably associated with the first lateral support 31.

Similarly, the second unwinding system 6 comprises two second arms 61, 62 coupled together and movably associated with the second lateral support 32.

The first arms 51, 52 are configured to move together, just as the second arms 61, 62 are configured to move together.

Each pair of arms 51, 52, 61, 62 is configured to lift a reel 21, 22 placed in the loading zone L.

Preferably, each pair of arms 51, 52, 61, 62 is configured to load the second new reel 22 when the first exhausted reel 21 reaches a further predetermined diameter below the first one.

In particular, the first arms 51, 52 and the second arms 61, 62 are configured to move either along a vertical direction Y, or along a horizontal direction X, either moving closer to or away from each other, to grasp and lift the reel 21, 22.

Each pair of arms 51, 52, 61, 62 is also configured to rotate a reel 21, 22 to unwind it axially. Each pair of arms 51, 52, 61, 62 is then configured to engage with a core 2 of a reel 21, 22 and to rotate it from the centre.

Preferably, the first support 31 comprises a first upright 50 for each first arm 51, 52. In other words, the first support 31 comprises two first uprights 50.

Each first upright 50 extends in the vertical direction Y.

Each first arm 51, 52 is, in particular, slidably constrained to the respective first upright 50.

The first support 31 further preferably comprises first sliding guides 53, 54 extending in a transverse direction X. Each first upright 50 is slidably constrained at respective ends to such first sliding guides 53, 54.

Similarly, the second support 32 preferably comprises a second upright 60 for each second arm 61, 62. In other words, the second support 32 comprises two second uprights 60.

Each second upright 60 extends in the vertical direction Y.

Each second arm 61, 62 is slidably constrained to the respective second upright 60.

Each first arm 51, 52 and each second arm 61, 62 is thus vertically movable by sliding on a respective upright 50, 60.

Still preferably, the second support 32 comprises second sliding guides 63, 64 extending in a transverse direction X. Each second upright 60 is slidably constrained at respective ends to such second sliding guides 63, 64. Each first arm 51, 52 and each second arm 61, 62 is therefore horizontally movable by sliding the respective upright 50, 60 to which it is constrained on the sliding guides 53, 54, 63, 64.

Preferably, moreover, each unwinding system 5, 6 comprises a torsion bar 55, 56, 65, 66 for each arm 51, 52, 61, 62.

Each torsion bar 55, 56, 65, 66 is slidably constrained to a respective upright 50, 60.

Accordingly, each first arm 51, 52 and each second arm 61, 62 is vertically movable by sliding the respective torsion bar 55, 56, 65, 66 on the respective upright 50, 60.

Each arm 51, 52, 61, 62 is also hinged to the respective torsion bar 55, 56, 65, 66. Accordingly, each arm 51, 52, 61, 62 is configured to rotate relative to the torsion bar 55, 56, 65, 66.

The arms 51, 52, 61, 62, torsion bars 55, 56, 65, 66 and uprights 50, 60 are in signal communication with the control unit, which controls movements thereof.

In greater detail, the first arms 51, 52 and the second arms 61, 62 are configured to switch from a first configuration in which they are transverse to the respective upright 50, 60 to a second configuration in which they are close to the respective upright 50, 60.

Figure 1:
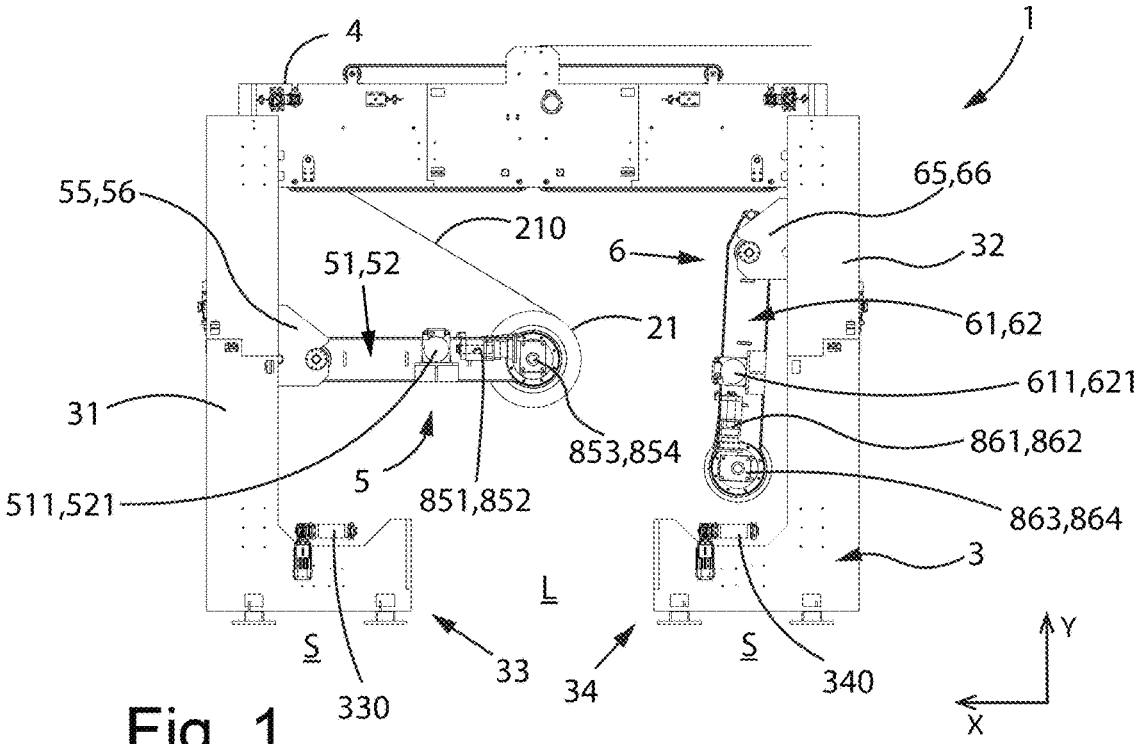
FIG. 1 shows a side view of an unwinder according to the present invention in a step of the reel unwinding process.

In particular, when in the first configuration, the first arms 51, 52 and the second arms 61, 62 are arranged so as to form an angle of between 80° and 100°, preferably of about 90° with the respective upright 50, Such a configuration can be seen in FIG. 1 for the first pair of arms 51, 52 and in FIGS. 4-8 for the second pair of arms 61, 62. On the other hand, in the second configuration, the first arms 51, 52 and the second arms 61, 62 are arranged so as to be substantially parallel to the respective upright 50, 60. Such a configuration is shown in FIGS. 2-7 for the first pair of arms 51, 52 and in FIGS. 1-3 for the second pair of arms 61, 62.

The first arms 51, 52 and second arms 61, 62 are configured to switch between the first and second configuration by rotating with respect to the respective torsion bar 55, 56, 65, 66.

In FIG. 1, for example, a first arm 51 in the first configuration and a second arm 61 in the second configuration are visible.

The arms 51, 52, 61, 62 are in the first configuration when the respective reel 21, 22 being held has a diameter greater than the first diameter.

The arms 51, 52, 61, 62 are configured to switch to the second configuration when the reel 21, 22 reaches the first diameter.

Preferably, each arm 51, 52, 61, 62 comprises a spindle 8 configured to engage with a core 2 of a reel 21, 22.

Each spindle 8 is configured to rotate to unwind the reel 21, 22. In particular, the spindles 8 of first arms 51, 52, and second arms 61, 62 are configured to rotate with respect to a horizontal direction X.

The spindles 8 of the first pair of arms 51, 52 are configured to rotate jointly and, similarly, the spindles 8 of the second pair of arms 61, 62 are configured to rotate jointly.

Still preferably, each arm 51, 52, 61, 62 comprises a first motor 511, 521, 611, 621 configured to set the respective spindle 8 in motion.

Accordingly, the first motors 511 and 521 of the first arms 51, 52 and the first motors 611 and 621 of the second arms 61, 62 are preferably coupled together so that the control unit operates them jointly in order to rotate the spindles 8 and consequently the reel 21, 22.

In particular, as the unwinding is of the axial type, the control unit is configured to progressively increase the speed of rotation of the spindles 8 of the pair of arms 51, 52, 61, 62 that are unwinding a reel 21, 22 as the diameter of the reel 21, 22 decreases.

Preferably, the spindles 8 are of the expandable type. In the case of expandable-type spindles 8, preferably each first arm 51, 52 and each second arm 61, 62 further comprises a second motor 851, 852, 861, 862 configured to open and close the spindle 8. Accordingly, each first arm 51, 52 and each second arm 61, 62 comprises a jack 853, 854, 863, 864 associated with the spindle 8 of the respective arm 51, 52, 61, 62, and configured to make the spindle 8 expandable and closable. Each second motor 851, 852, 861, 862 is then configured to work with the respective jack 853, 854, 863, 864 to open and close the spindle 8. Preferably, the spindle 8 has an opening/closing range between 150 and 450 mm, to interact with cores 2 of reels 21, 22 having different dimensions.

The spindles 8 are configured to be fitted inside the core 2 of a reel 21, 22 of at least a predetermined minimum length to ensure sealing. Such a minimum length is, for example, between 200 and 800 mm. For example, each spindle 8 of a pair of arms 51, 52, 61, 62 is fitted by a length of 500 mm into the core 2 of a reel 21, 22 having a diameter of 3 metres and a length of 2850 mm.

According to a preferred embodiment, shown in FIGS. 1-9, the supporting structure 3 comprises a first support base 33 extending away from the first support 31 towards the second support 32.

According to this embodiment, the supporting structure 3 also comprises a second support base 34 that extends away from the second support 32 towards the first support 31.

The first base 33 and the second base 34 are spaced apart from each other, thus defining the above-mentioned loading zone L of a reel 21, 22 to be unwound, to be loaded into the unwinder 1 by means of the first arms 51, 52 or by means of the second arms 61, 62.

The first base 33 and second base 34 are in particular configured to accommodate a respective exhausted reel 21, 22.

Preferably, the first base 33 and the second base 34 comprise respective conveyor belts 330, 340. In particular, the conveyor belts 330, 340 are configured to move an exhausted reel 21, 22 placed on the respective base 33, 34 to an unloading zone S. For example, the conveyor belts 330, 340 are configured to move, and then let the reel 21, 22 drop in the unloading zone S.

The unloading zone S, in this sense, is defined as adjacent to the unwinder 1, both at the first support 31 and at the second support 32. In case a lateral support 31, 32, is present, i.e. a pair of arms 51, 52, 61, 62 suitable for unwinding a reel 21, 22, also an unloading zone S of an exhausted reel 21, 22 is present.

In the above-mentioned unwinder 1, as two bases 33, 34 are present, there are two separate unloading zones S.

The operation of the unwinder 1 is described hereinafter.

The first reel 21 is unwound axially by means of the first unwinding system 5, as shown in FIG. 1.

During the unwinding step, when the first reel 21 reaches a diameter smaller than a predetermined first diameter, the first arms 51, 52, switch to the second configuration, rotating of about 90 degrees clockwise.

Figure 2:
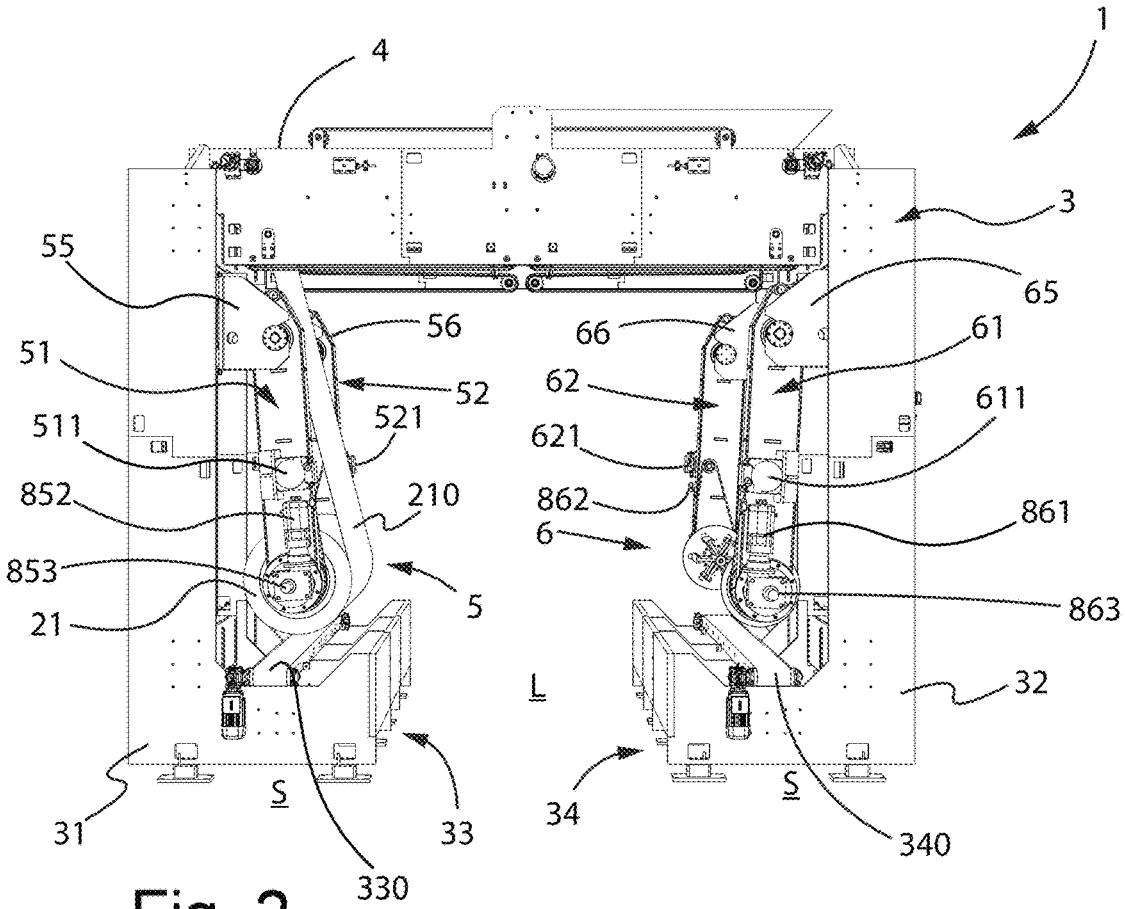
FIG. 2 shows a perspective side view of the unwinder of FIG. 1 at a further step of the process.

In FIG. 2 there are shown the first arms 51, 52 in the second configuration, with the first reel 21 being exhausted, and also the second arms 61, 62 in the second configuration.

Figure 3:
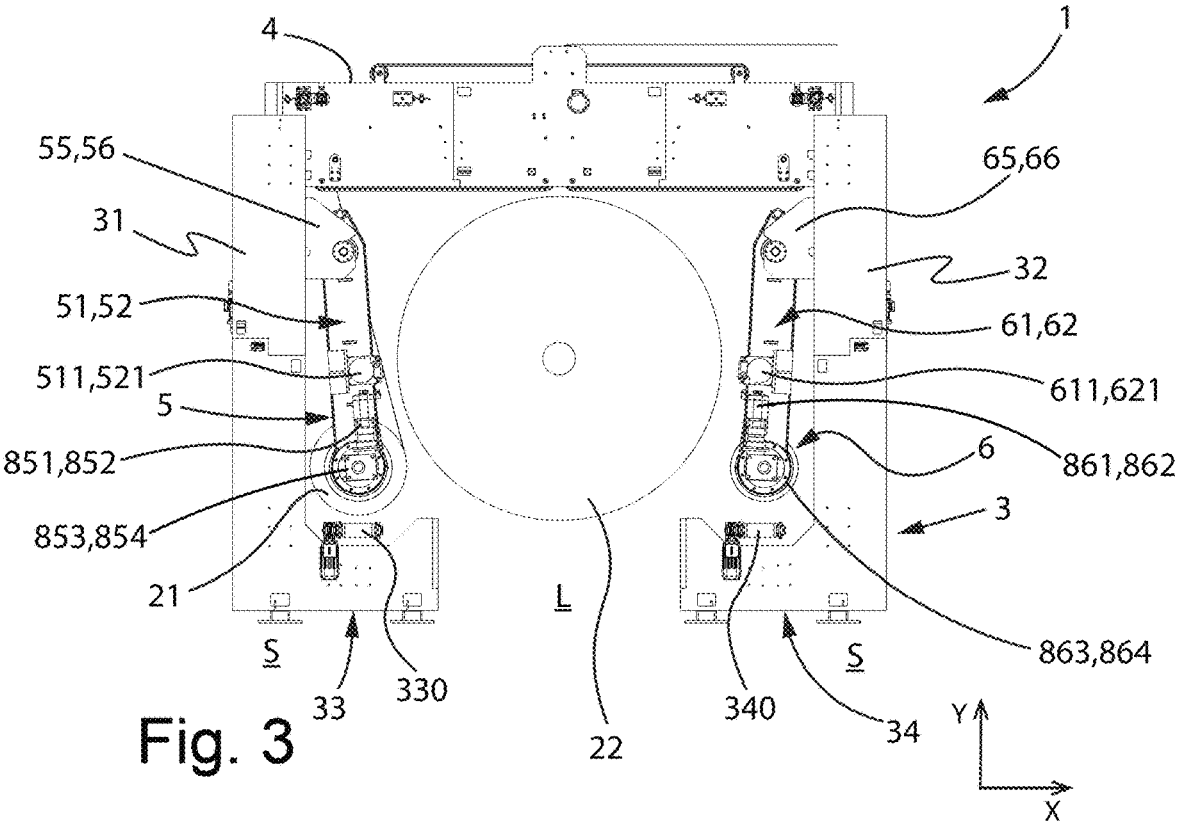
FIG. 3 shows a side view of the unwinder of FIG. 1 in a further step of the process.

Still during the step of unwinding the first reel 21, a second reel 22 is brought, either manually or automatically, into the loading zone L. This step is shown in FIG. 3, wherein the second reel 22 is in the loading zone L, supported by a transport element (not shown in FIG. 3).

Figure 4:
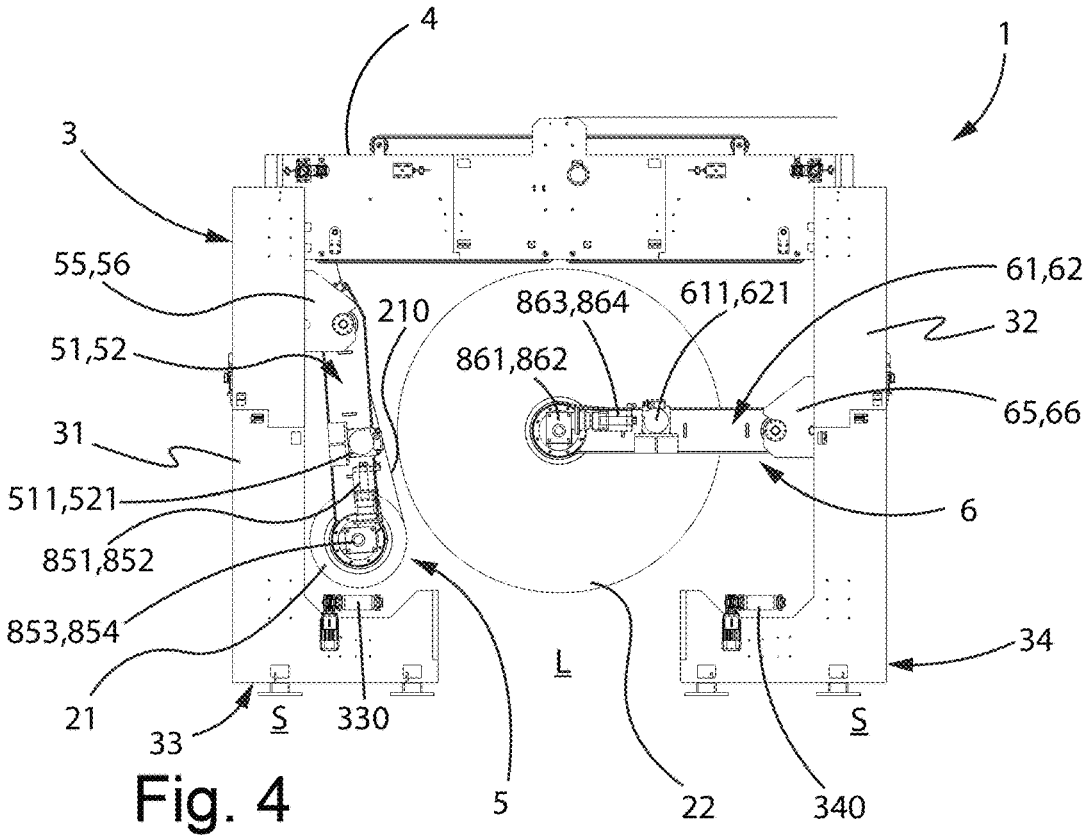
FIG. 4 shows a side view of the unwinder of FIG. 1 in a further step of the process.

The second arms 61, 62, opposite those used for unwinding the first reel 21, rotate switching from the second configuration to the first configuration in order to pick up the second reel 22, as shown in FIG. 4. In such a case, the second arms 61, 62 still rotate clockwise, the two supports 31, 32 being symmetrical to each other (whereas in order to switch from the first to the second configuration, the two second arms 61, 62 rotate counter-clockwise, unlike the first arms 51, 52). At this step, the second reel 22 is still supported by the transport element (not visible in FIG. 4).

Figure 5:
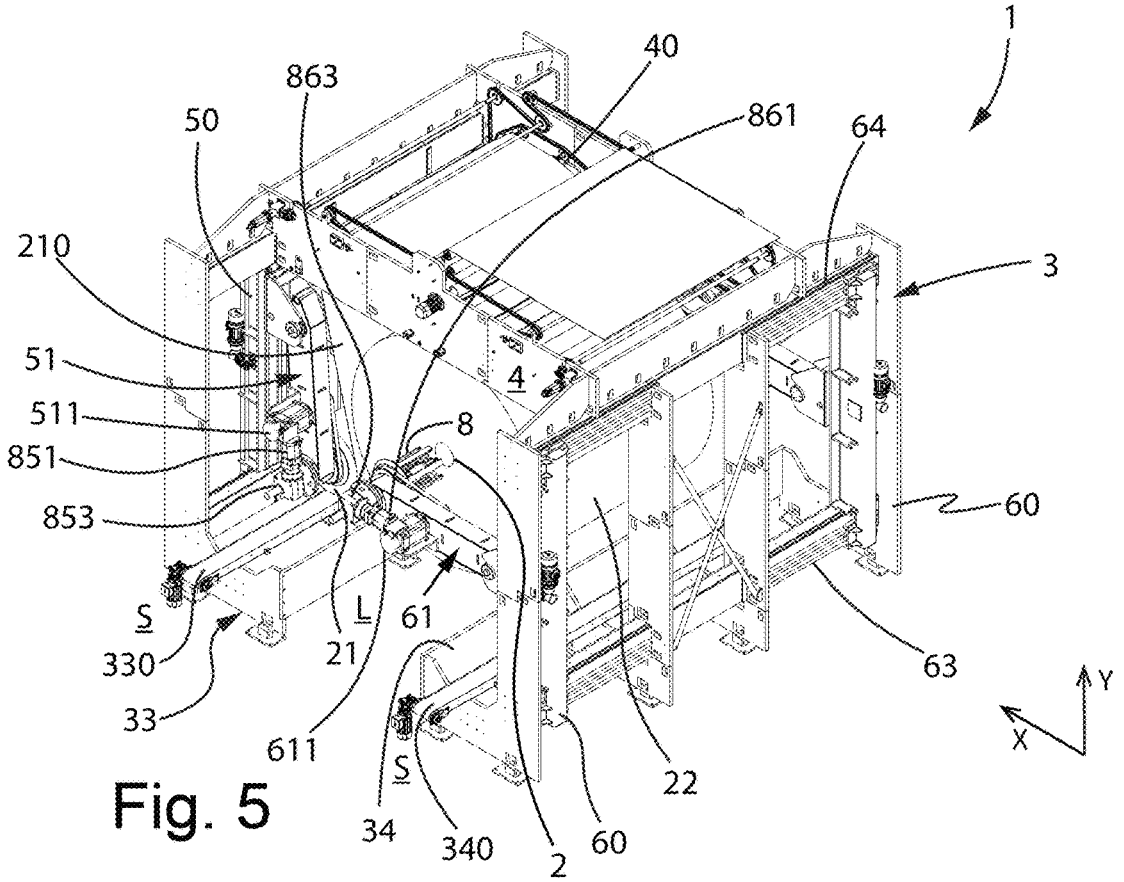
FIG. 5 shows a perspective view of the unwinder of FIG. 1 in a further step of the process.

At that step, the second arms 61, 62 have a maximum opening dimension, which is greater than the length of the core 2 of the second reel 22, in order to be able to grip the reel 22, as shown in FIG. 5. Still in Figure before gripping the second reel 22, the spindles 8, if expandable, are close to the core 2 and are close to the minimum size to allow fitting them into the core 2. At this step, the second reel 22 is still supported by the transport element (not visible in FIG. 5).

The second arms 61, 62 move vertically from above downwards and then upwards again to centre the spindle 8 on the hole of the core 2 of the reel 22.

Figure 6:
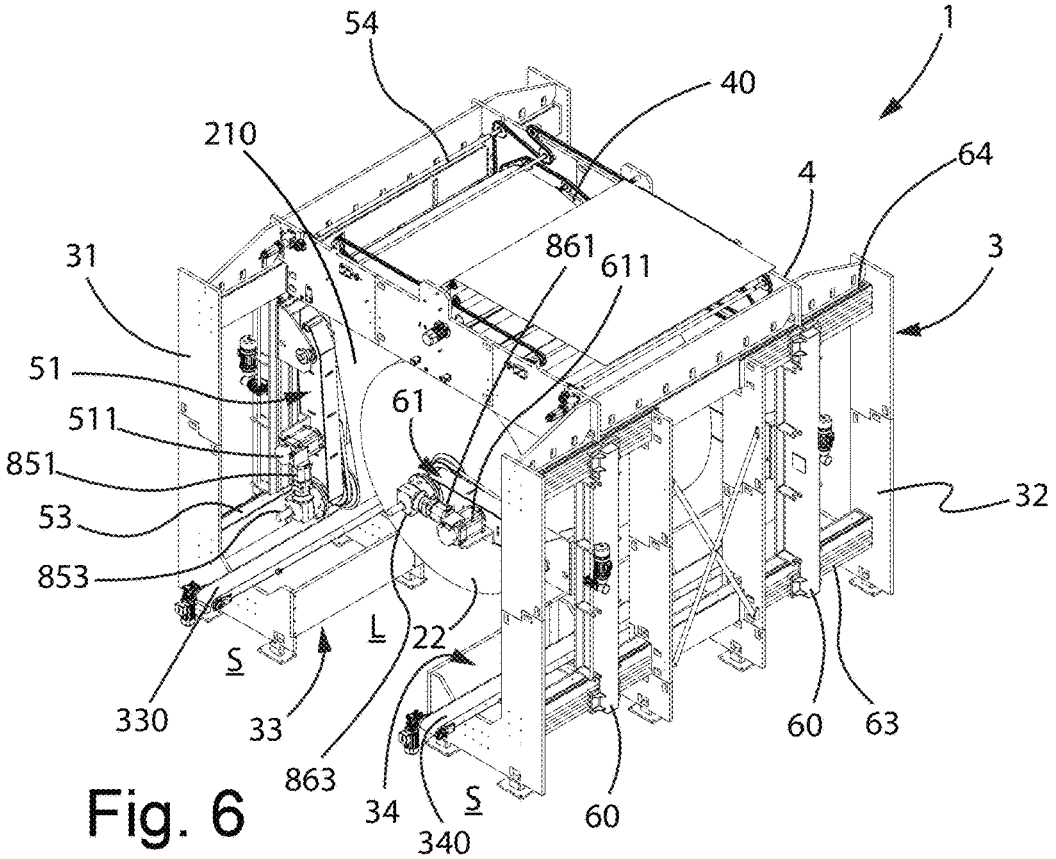
FIG. 6 shows a perspective view of the unwinder of FIG. 1 in a further step of the process.

Once the hole of the core 2 is centred, the arms 61, 62 move towards each other to have each spindle 8 enter the core 2 of the reel 22, as shown in FIG. 6. At this step, the second reel 22 is no longer supported by the transport element.

Subsequently, the spindles 8 expand to grip the core 2 internally and allow unwinding the reel 22 by means of the first motors 611, 621 of the second pair of arms 61, 62.

Figure 7:
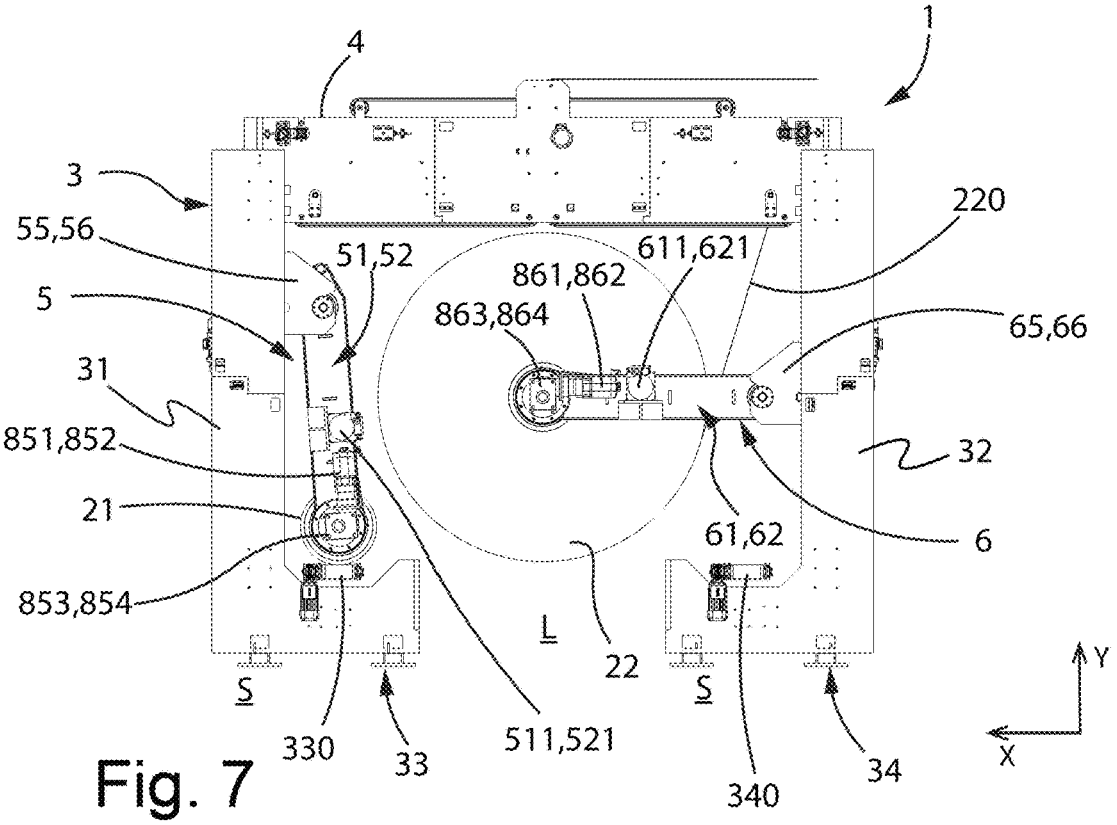
FIG. 7 shows a side view of the unwinder of FIG. 1 in a further step of the process.

When the exchange and joint have been made, the step of unwinding the second new reel 22 begins, as shown in FIG. 7, by means of the second unwinding system 6.

The spindles 8 of the first arms 51, 52 close and only then do the first arms 51, 52 open, causing the spindles 8 to exit the core 2 of the first reel 21 to let the exhausted reel 21 drop onto the respective conveyor belt 330.

Figure 8:
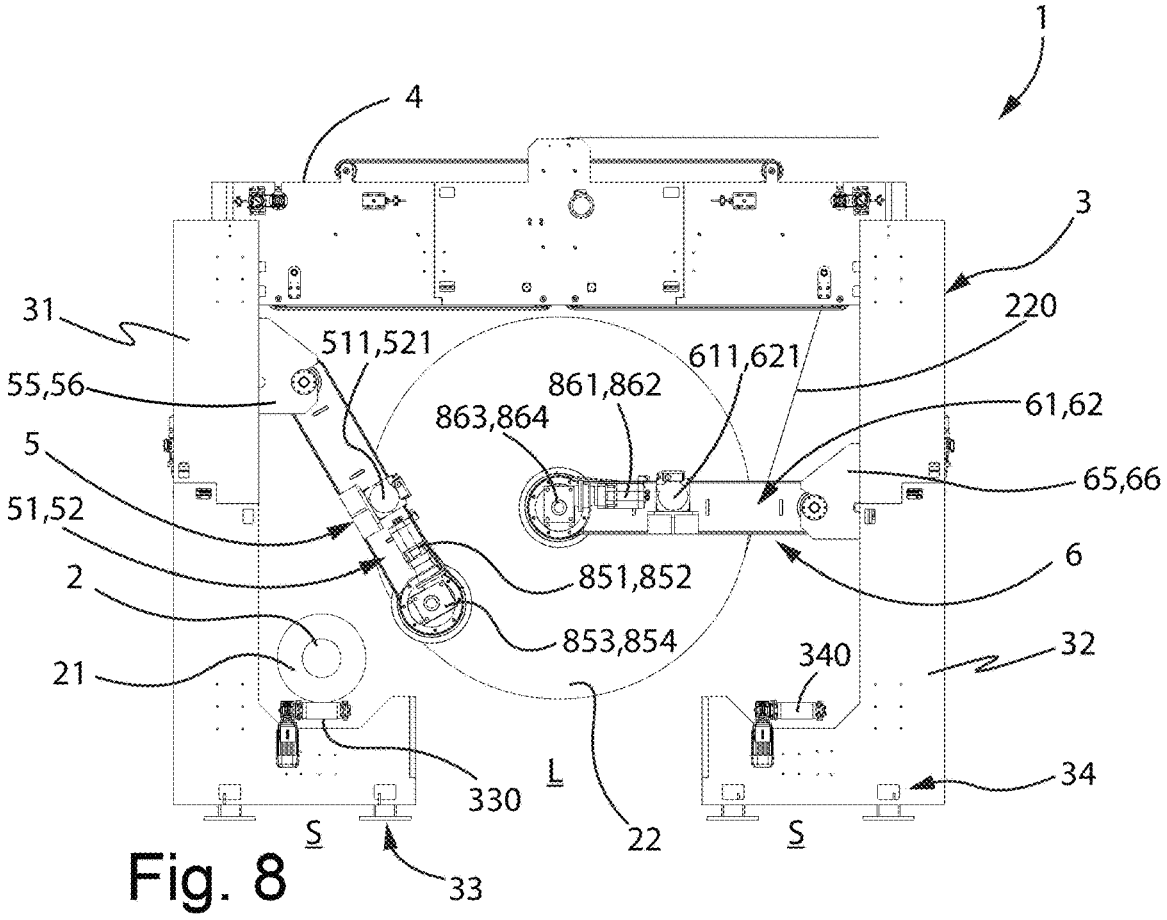
FIG. 8 shows a side view of the unwinder of FIG. 1 in a further step of the process.
Figure 9:
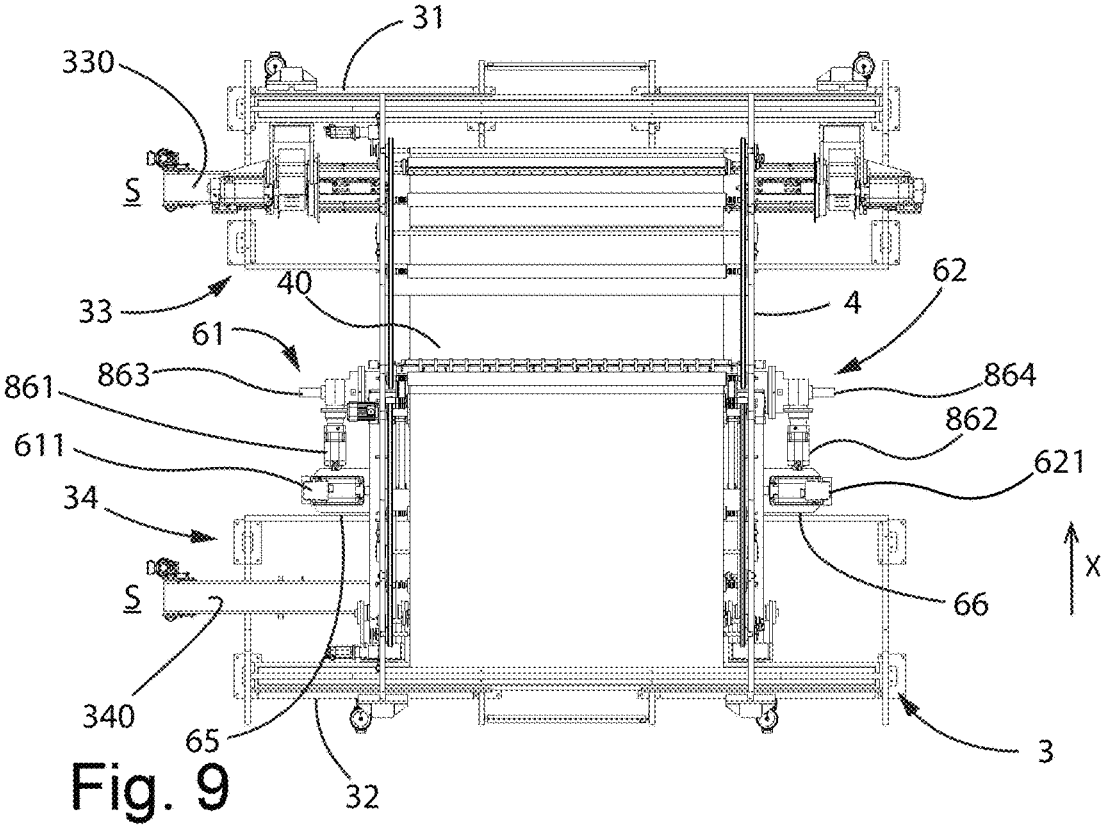
FIG. 9 shows a view from above of the unwinder of FIG. 1.

Referring to FIG. 8, the first arms 51, 52 then rotate upwards to leave room for the core 2 to be transported via the conveyor belt 330 and to be unloaded in the unloading zone S.

A plant 100, at least partly automatic, also forms a part of the present invention. Such a plant 100 is suitable for the semi-automatic unwinding of reels 21, 22 of paper by means of the unwinder 1 described above.

Referring to FIG. 20, the system 100 according to the present invention comprises a preparation station P, configured to prepare a reel 21, 22 coming from a warehouse for the unwinding operation. At such a station, the protective film wrapping the reel 21, 22, such as cellophane, is removed.

Such a reel 21, 22 may be brought to the preparation station P by an automatic reel-conveying machine 9, schematically shown in FIG. 10, which is configured to stop next to the preparation station P and possibly act as an aid to the preparation of the reel 21, 22 for the unwinding operation.

The preparation station P also includes a stand 91 on which the reel 21, 22 is placed once it has been prepared for unwinding.

The plant 100 also comprises an unwinding station W, comprising at least an unwinder 1 as described above and a loading zone L.

The system 100 may comprise, in the unwinding station W, multiple unwinders 1, wherein the unwinders 1 are placed adjacent to each other, with the lateral supports 31, 32 facing each other and/or with the lateral supports 31, 32 aligned with each other.

The unwinding station W further comprises at least one unloading zone S.

The system 100 depicted comprises, for example, an unloading zone S for each support base 33, 34 of each unwinder 1.

It should be noted that, according to the present invention, the plant 100 comprises a transport element 10 configured to accommodate the reel 21, 22 and to transport the reel 21, 22.

Preferably, the transport element 10 is an automatic shuttle.

In this case, the plant 100 comprises a central control unit (not shown) in signal communication with the control unit of the unwinder 1 and the automatic shuttle, in order to drive transport thereof.

According to one embodiment, the shuttle, shown in FIGS. 11*a* and 11*b*, comprises a carriage 11 comprising at least two wheels 12, in which control electronics are contained. The shuttle also comprises a tray 13, placed on top of the same carriage 11.

Preferably the shuttle comprises two support fins 131 extending away from the tray 13 in an oblique direction and configured to embrace the reel 21, 22 in order to prevent it from rolling.

The transport element 10 has such dimensions to accommodate a new reel 21, 22. The carriage 11, for example, has dimensions of 2000 mm×2000 mm for 1.5 metre or 3 metre reels. The length of the tray 13 is preferably similar or equal to the length of the core 2 of the reel 21, 22.

Still preferably, the transport element 10 is configured to move on a pre-tracked path G. This pre-tracked path G connects the various stations mentioned above and others described hereinafter.

In particular, the transport element 10 is configured to transport the reel 21, 22 from the preparation station P to the unwinding station W. Specifically, the transport element 10 is configured to pick up the reel 22 from the stand 91 when the first reel 21 being unwound reaches the first predetermined diameter, to bring it to the loading zone L.

At the same time, the respective first arms 51, 52 in which the first reel 21 is being unwound switch to the second configuration to leave room for positioning the new reel 22 in the loading zone L.

Once the reel 21, 22 has been brought into the loading zone L, the transport element 10 is configured to stay in the loading zone L until one of the pairs of arms 51, 52, 61, 62 lifts the reel 21, 22.

In particular, one of the pairs of arms 51, 52, 61, 62 lifts the new reel 22, already positioned in the loading zone after the first reel 21 has reached a first predetermined diameter, at the moment when the first exhausted reel 21 reaches a further predetermined diameter below the first predetermined diameter.

Subsequently, when the first exhausted reel 21 reaches a second predetermined diameter that is smaller than the further predetermined diameter, a joint is made between the first reel 21 and the second reel 22 in order to carry out the reel exchange before the first reel 21 is totally exhausted.

In the plant 100, the transport element 10 is also configured to move from the loading zone L to an unloading zone S close to the first base 33 and/or the second base 34 after one of the pairs of arms 51, 52, 61, 62 has lifted the reel 21, 22 from the transport element 10.

The unwinder 1 is preferably configured to let the exhausted reel 21, 22 drop onto the transport element 10 when the transport element 10 is in the unloading zone S. Thereby, the exhausted reel 21, 22 is dropped onto the transport element 10, which can then move it away from the unwinder 1.

Preferably, the plant 100 also comprises a deposit station Z suitable for accommodating exhausted reels 21, 22.

Therefore, the transport element 10 is also configured to transport an exhausted reel 21, 22 from the unloading zone S to the deposit station Z.

At the deposit station Z, the exhausted reels 21, 22 are cleaned from residual paper, e.g. by an operator, so that the core 2 can be reused.

Optionally, such a step is automated.

Optionally, the plant 100 also includes an exchange station K for incomplete reels.

In this case, the transport element 10 is configured to move also to the exchange station K.

A process for unwinding reels 21, 22 by means of an unwinder 1 as described above also forms a part of the present invention.

In particular, the process comprises an initial step of preparing a first reel 21 for unwinding.

Such a step is preferably performed manually by an operator who removes the protective film surrounding the reel 21, 22.

The process comprises a step of transporting the first reel 21 to the loading zone L.

The process comprises a further step of loading a first reel 21 into the unwinder 1 by means of the first arms 51, 52.

Once the first reel 21 has been loaded, the process then comprises a subsequent step of starting the unwinding of the first reel 21.

According to the process according to the present invention, when the first reel 21 reaches a first predetermined diameter, a step of transporting a second reel 22 to the loading zone L is comprised.

The process comprises a step of loading the second reel 22 into the unwinder 1 by means of the second arms 61, 62 after the second reel 22 has been transported to the loading zone L. In particular, such a step is carried out when the first reel 21 reaches a further predetermined diameter below the first predetermined diameter.

When the first reel 21 reaches a second predetermined diameter smaller than said first predetermined diameter, the process provides joining a first ply 210 belonging to the first reel 21 and a second ply 220 belonging to the second reel 22 to perform a reel exchange between the first reel 21 and the second reel 22. The second predetermined diameter is also smaller than the further predetermined diameter.

Such a joining step is performed automatically.

The process then comprises successive steps of starting the unwinding of the second reel 22 and interrupting the unwinding of the first reel 21.

In particular, the step of interrupting the unwinding of the first reel 21 is carried out after the step of starting the unwinding of the second reel 22.

It is thereby possible to avoid downtime and optimise the process of unwinding reels by speeding up the reel exchange passage, placing a new second reel 22 near the unwinder 1, and loading it, even making the joint, before a first reel 21 is exhausted. Thereby, the unwinder 1, being automated, ensures a continuous unwinding process of the reels.

The unwinder, plant and process for unwinding reels thus conceived are susceptible to numerous modifications and variations, all falling within the scope of the inventive concept; moreover, all the details may be replaced by technically equivalent elements. In practice, the materials used, as long as they are compatible with the specific use, as well as the dimensions and the contingent shapes, may be any according to the technical requirements.

The invention claimed is:

1. An unwinder for unwinding reels of paper, said unwinder comprising:

a supporting structure partially closed and defining an internal space suitable for unwinding at least one reel; said supporting structure comprising:

a first lateral support;

a second lateral support spaced from said first lateral support;

a crosspiece interposed above and between the first and the second lateral support, said crosspiece defining with said first lateral support and second lateral support, said partially closed structure;

said unwinder further comprising:

a first axial unwinding system placed at the first lateral support and configured to axially unwind a first reel of the at least one reel;

a second axial unwinding system placed at the second lateral support and configured to unwind a second reel of the at least one reel;

a joining device placed at the crosspiece and configured to make a joint between a first ply belonging to the first reel and a second ply belonging to the second reel to perform a reel exchange;

said second axial unwinding system being configured to load said second reel from a loading zone after said first reel being unwound on said first axial unwinding system reaches a first predetermined diameter;

said joining device being configured to make said joint between said first reel and said second reel when the first reel reaches a second predetermined diameter smaller than said first predetermined diameter;

said second axial unwinding system being configured to unwind said second reel after said joint has been made, said first axial unwinding system being configured to interrupt the unwinding of said first reel after said second axial unwinding system has started unwinding the second reel, wherein said first axial unwinding system comprises two first arms coupled together and movably associated with the first lateral support;

said second axial unwinding system comprises two second arms coupled together and movably associated with the second lateral support;

each pair of said first and second arms being configured to lift the first reel or the second reel placed in the loading zone and to rotate it to unwind it axially, and wherein the first lateral support comprises:

a first upright for each first arm, each first upright extending in a vertical direction; each first arm being slidably constrained to the respective first upright;

first sliding guides extending in a transverse direction and to which each first upright is slidably constrained at the ends;

and the second lateral support comprises:

a second upright for each second arm, each second upright extending in a vertical direction; each second arm being slidably constrained to the respective second upright;

second sliding guides extending in a transverse direction and to which each second upright is slidably constrained at the ends.

2. The unwinder according to claim 1, wherein the first arms and the second arms are configured to switch from a first configuration in which they are transverse with respect to the respective upright to a second configuration in which they are close to each respective first and second upright, said first and second arms being in said first configuration when the respective reel has a diameter greater than the first predetermined diameter; said first and second arms being configured to switch towards said second configuration when the respective reel reaches said first predetermined diameter.

3. The unwinder according to claim 1, wherein each first and second axial unwinding system comprises a torsion bar for each first and second arm;

each torsion bar being slidably constrained to each respective first and second upright;

each first and second arm being hinged to the respective torsion bar and being configured to rotate with respect to the respective torsion bar.

4. The unwinder according to claim 1, wherein each first and second arm comprises:

a spindle configured to engage with a core of the respective reel;

a first motor configured to rotate the respective spindle.

5. The unwinder according to claim 1, wherein said supporting structure comprises:

a first base extending away from the first lateral support towards the second lateral support;

a second base extending away from the second lateral support towards the first lateral support; said first base and said second base being spaced apart from each other defining the loading zone of the respective reel to be unwound; said first base and second base being configured to accommodate a respective exhausted reel.

6. The unwinder according to claim 5, wherein said first base and said second base comprise respective conveyor belts configured to move an exhausted reel placed on said respective base towards an unloading zone.

7. A plant at least partly automatic, comprising:

a preparation station configured to prepare a reel coming from a warehouse for unwinding;

an unwinding station comprising at least one unwinder according to claim 1, and a loading zone;

a transport element configured to house said reel and to transport said reel from the preparation station to the unwinding station.

8. The plant according to claim 7, wherein said transport element is an automatic shuttle; said transport element being configured to remain in said loading zone until one of a pair of said first or second arms of the unwinder lifts said reel.

9. The plant according to claim 8, wherein said supporting structure comprises a first base extending away from the first lateral support towards the second lateral support and a second base extending away from the second lateral support towards the first lateral support, wherein said transport element is configured to move from said loading zone to an unloading zone close to said first base and/or said second base after one of said pair of said first or second arms has lifted said reel from said transport element; said unwinder being configured to discharge said reel once said reel is exhausted onto said transport element when the transport element is in the unloading zone.

10. The plant according to claim 9, comprising a deposit station suitable for accommodating the reel that is exhausted; said transport element being configured to transport the reel that is exhausted from said unloading zone to said deposit station.

11. A process for unwinding reels with an unwinder according to claim 1, said process comprising the steps of:

preparing a first reel for unwinding;

transporting said first reel to said loading zone;

loading the first reel into said unwinder with the first arms of the unwinder;

starting the unwinding of the first reel;

when the first reel reaches a first predetermined diameter, transporting a second reel to said loading zone;

loading said second reel into said unwinder with the second arms of the unwinder;

when the first reel reaches a second predetermined diameter smaller than said first predetermined diameter, joining a first ply belonging to the first reel and a second ply belonging to the second reel to perform a reel exchange between the first reel and the second reel;

starting the unwinding of the second reel;

interrupting the unwinding of the first reel; said step of interrupting the unwinding of the first reel being carried out after the step of starting the unwinding of the second reel.

* * * * *